US006797231B2

(12) United States Patent
Matsui et al.

(10) Patent No.: US 6,797,231 B2
(45) Date of Patent: Sep. 28, 2004

(54) STEEL FOR MACHINE STRUCTURAL USE

(75) Inventors: Naoki Matsui, Amagasaki (JP); Koji Watari, Kobe (JP); Takayuki Nishi, Kashima (JP); Toru Kato, Kashima (JP); Hitoshi Matsumoto, Kitakyushu (JP); Hiroaki Tahira, Amagasaki (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 132 days.

(21) Appl. No.: 10/295,032

(22) Filed: Nov. 15, 2002

(65) Prior Publication Data

US 2003/0138343 A1 Jul. 24, 2003

(30) Foreign Application Priority Data

Nov. 15, 2001 (JP) ..... 2001-350470

(51) Int. Cl.[7] ..... C22C 38/14; C22C 38/06; C22C 38/60; C22C 38/02

(52) U.S. Cl. ..... 420/84; 420/87; 420/126; 420/110; 420/128; 420/109

(58) Field of Search ..... 148/333–335, 148/320, 331; 420/109, 110, 126, 128, 84, 87

(56) References Cited

U.S. PATENT DOCUMENTS

| | | | | |
|---|---|---|---|---|
| 3,861,906 A | * | 1/1975 | Tipnis et al. | 420/84 |
| 4,431,445 A | | 2/1984 | Furusawa et al. | 75/123 R |
| 4,719,079 A | | 1/1988 | Katayama et al. | 420/84 |
| 4,810,287 A | * | 3/1989 | Saka et al. | 420/115 |
| 5,961,747 A | * | 10/1999 | DeArdo et al. | 148/332 |
| 6,200,527 B1 | * | 3/2001 | Damie et al. | 420/84 |

FOREIGN PATENT DOCUMENTS

| | | |
|---|---|---|
| JP | 57-19357 | 2/1982 |
| JP | 57-140854 | 8/1982 |
| JP | 62-103340 | 5/1987 |
| JP | 08-092687 A | 4/1996 |
| JP | 11-222646 | 8/1999 |
| JP | 2000-34538 | 2/2000 |
| JP | 2000-219936 | 8/2000 |
| JP | 2000-282169 | 10/2000 |
| JP | 2000-282171 | 10/2000 |
| JP | 2001-131684 | 5/2001 |
| JP | 2001-152279 | 6/2001 |
| JP | 2001-335885 | 12/2001 |
| JP | 2002-180184 | 6/2002 |
| JP | 2002-180194 | 6/2002 |
| JP | 2002-226939 A | 8/2002 |

* cited by examiner

*Primary Examiner*—Deborah Yee
(74) *Attorney, Agent, or Firm*—Clark & Brody

(57) ABSTRACT

The invention provides a steel for machine structural use, which is excellent in machinability, comprising, in percent by mass, C: 0.1–0.6%. Si: 0.01–2.0%, Mn: 0.2–2.0%, S: 0.005–0.2%, Al: not more than 0.009%, Ti: not less than 0.001% but less than 0.04%, Ca: 0.0001–0.01%, O (oxygen): 0.0010–0.01%, and N: not more than 0.02% and satisfying the following relations (1) to (3):

$$n_0/S\ (\%) \geqq 2500 \quad (1)$$

$$n_1/n_0 \leqq 0.1 \quad (2)$$

$$n_2 \geqq 10 \quad (3)$$

where $n_0$: total number of sulfide inclusions not smaller than 1 $\mu$m per mm$^2$ of a cross section parallel to the direction of rolling (number/mm$^2$); $n_1$: number of MnS inclusions having not smaller than 1 $\mu$m and containing not less than 1.0% of Ca per mm$^2$ of a cross section parallel to the direction of rolling (number/mm$^2$); $n_2$: number, per mm$^2$ of a cross section parallel to the direction of rolling, of oxide inclusions having a specific composition comprising CaO—$Al_2O_3$—$SiO_2$—$TiO_2$ and having a diameter of not less than 1 $\mu$m (number/mm$^2$).

4 Claims, 5 Drawing Sheets

STEEL FOR MACHINE STRUCTURAL USE

FIELD OF THE INVENTION

This invention relates to a steel for machine structural use, which is to be subjected to machining for use as industrial machinery or automotive parts, among others. More particularly, the invention relates to a steel for machine structural use excellent in chip disposability and effective in prolonging the cutting tool life (hereinafter referred to as "tool life improvement").

PRIOR ART

Among the steels for machine structural use, which are used as industrial machinery or automotive parts, among others, there are steels for machine structural use as defined in the Japanese Industrial Standard JIS G 4051, and such alloy steels as nickel-chromium steels according to JIS G 4102, nickel-chromium-molybdenum steels according to JIS C 4103, chromium steels according to JIS G 4104 and manganese and manganese-chromium steels for machine structural use according to JIS G 4106. Also in use are steels improved in hardenability by modifying the amount of addition of the specified components of these steels or by adding B (boron) or the like and/or improved in metallurgical structure by addition of Ti, Nb: V and/or the like.

In many cases, these steels are subjected, after rolling or after further forging or other working, to machining to desired forms or shapes, followed by heat treatment according to the required characteristics, to give final products. For improving the productivity in this machining step, it is strongly desired that the steels be excellent in machinability. Good machinability means that the period between exchanges of tools for use in machining due to wear is long, that is, that the tool life is long, that chips generated during machining can be finely torn and separated, that the cutting force is not so great, and that good machined or ground surfaces can be obtained.

With the advancement in automation of machining, not only the tool life but also the separability of chips, namely "chip disposability", becomes very important. Since the tool life is influenced by the characteristics of the material steel as well as the performance characteristics of the tool, tool selection is also important. On the contrary, good chip disposability means that chips generated during machining are finely torn or divided and separated but will not entwine the tool. The chip disposability greatly depends on the characteristics of the material steel. For improving the machinability of steel, it is very important to improve this chip disposability.

The machinability of steel can be improved by addition of Pb. However, addition of Pb not only increases the cost of steel but also may lead to environmental contamination. Therefore, investigations have been carried out in search of technologies of improving the machinability of steel without adding Pb. A typical one is the technology of improving the machinability by utilizing MnS inclusions. This technology has been studied in various aspects and already put to practical use.

Thus, for example, the steel disclosed in Japanese Patent Publication (JP Kokoku) H05-15777 contains Mn—Ca—S type inclusions with a Ca content of 3—55% as uniformly dispersed therein. As for their sizes, the major axis L is not longer than 20 $\mu$m and the ratio thereof to the minor axis W (L/W) is not more than 3. In this steel, however, individual sulfide inclusions become coarse, hence the number of sulfide inclusions at the same S concentration decreases. Therefore, the improvement in chip disposability is not entirely satisfactory. In addition, because the steel is Al-killed steel, even after treatment with Ca, the oxide inclusions are of the CaO—$Al_2O_3$ type, hence the improving effects on the machinability such as tool life are not very satisfactory. When an attempt is made to disperse a large number of sulfide inclusions containing a high concentration of CaS by increasing the S concentration, addition of a large amount of Ca is required, and this disadvantageously causes an increase in cost.

Laid-open Japanese Patent Application (JP Kokai) 2001-131684 discloses steels for machine structural use, in which manganese sulfide-based inclusions have an average oxygen content of not more than 10%. The steels have the following principal composition, in % by mass: C: 0.05–0.7%, Si: not more than 2.5%, Mn: 0.1–3.0%, Al: not more than 0.1%, S: 0.003–0.2%, N: 0.002–0.025%, and O (oxygen): not more than 0.003%, with the balance being Fe. In addition to these components, the steels may contain not more than 0.01%, in total, of one or more elements selected from the group consisting of rare earth elements, Ca and Mg.

However, the steels according to the invention disclosed in JP Kokai 2001-131684, as described in the example section thereof, contain not less than 0.018% of Al used as a deoxidizer clement so that the average oxygen concentration in sulfides may be reduced to 10% or less for obtaining such a sulfide form as effective in improving the chip disposability. In such a case, the oxides in steel are mainly hard $Al_2O_3$ type oxides, and the tool life is improved only to an unsatisfactory extent. Thus, the invention disclosed in the above-cited publication is not an invention made in an attempt to improve the chip disposability and, at the same time, improve the tool life.

In JP Kokai 2000-34538, there is disclosed a steel for machine structural use which contains C, Si, Mn, P, S, Al, Ca and N each in a specified amount and is excellent in machinability in turning. This steel has the following characteristic features. Namely, the following two relations are satisfied:

$$A/(A+B+C) \leqq 0.3 \text{ and } B/(A+B+C) \geqq 0.1$$

wherein A is the area percentage of sulfide inclusions having a Ca content exceeding 40% relative to the total area of an investigation field of view, B is the area percentage of sulfide inclusions having a Ca content of 0.3–40% relative to the total area of the investigation field view, and C is the area percentage of sulfide inclusions having a Ca content of less than 0.3% relative to the total area of the investigation field of view. The steel of JP Kokai 2000-34538 is characterized by increasing sulfide containing 0.3–40% of Ca. However, increase of such sulfide of high Ca content makes the sulfide coarse and makes improvement of chip disposability difficult.

JP Kokai 2000-282169 discloses a steel, which contains C, Si, Mn, P and S and further contains one or more elements selected from among Zr, Te, Ca and Mg and satisfies the conditions: Al≦0.01%, total O≦0.2% and total N≦0.02%. This steel is excellent in forgeability owing to spheroidizing of sulfide inclusions and has good machinability. Thus, on the premise that Ca is added, it is intended that Ca solutes in MnS and lowers the deforming ability of MnS for spheroidizing the same in this steel. In this case, however, individual sulfide inclusions become coarse, whereby that sulfide morphology suited for providing good chip disposability cannot he obtained, hence the improvement in chip disposability is not yet satisfactory.

All the steels disclosed in the above mentioned publications may contain Ca and are improved primarily in machinability. However, it cannot be said that sufficient considerations have been given to the level of addition of Ca, the timing of addition thereof and the dissolved oxygen content in the steel. Thus, they are not satisfactorily improved simultaneously in chip disposability and in tool life.

It is an object of the present invention to provide a steel for machine structural use, which is improved in machinability, especially in chip disposability and, at the same time, can prolong the tool life, without containing Pb.

SUMMARY OF THE INVENTION

It is well known that the machinability of steel is greatly influenced by the state of sulfide and/or oxide inclusions in the steel. For improving the machinability of Pb-free steels for machine structural use, the present inventors made close investigations concerning the relationship between the form and distribution of inclusions in the steels and the machinability thereof, and studied the investigation results. The inventors paid attention to the effects of Ca and Ti, in particular, and investigated the steelmaking conditions as well. In the process of these investigations and studies, the inventors reveal the following remarkable facts.

Ca strongly binds to S and alters the form of sulfide inclusions, mainly MnS, and shows a large bonding strength with oxygen, leading to stable oxide formation.

When Ca is added without paying any attention to the steelmaking conditions, CaS or Ca-based oxides formed in the molten steel serve as nuclei for the formation of MnS grains and the number of sulfide inclusions having a Ca content of not less than 1% increases. It was found, however, that when, in adding Ca, the steelmaking conditions, such as the level of addition thereof, the dissolved oxygen level and the timing of addition of Ca, are appropriately selected, sulfide inclusions mainly composed of MnS not containing Ca are formed in large amounts. Further, it was revealed that the chip disposability of steel becomes improved only in such case.

There are two type inclusions, i.e., sulfide type one and oxide type one. Since minute inclusions such as precipitates are not effective in machinability improvement, it was decided that the size of inclusion should be evaluated in terms of the diameter of a circle equivalent in area to the inclusion in the observation field of view, and investigations were made regarding inclusions greater in such diameter than a certain level.

As a result, it was found that when the number of almost Ca-free sulfide exceeds 90%, or, in other words, when the number of Ca-containing MnS type inclusions is less than 10%, particularly good chip disposability can be obtained.

When compared at the same S content level, steels, in which a large number of small sulfide inclusions are present, are superior in chip disposability to steels in which a small number of coarse sulfide inclusions are present. When an increased amount of sulfides containing Ca as solid solution is present in the molten steel or at the initial stage of solidification, they serve as nuclei for crystallization of MnS, giving coarse sulfide inclusions. Therefore, at the same S concentration, the number of dispersed sulfide inclusions decreases and fine sulfide inclusions are hardly formed. When, on the other hand, the amount of sulfide inclusions containing Ca as solid solution is small, the sulfide inclusions mostly form a large number of fine sulfide inclusions.

A chip generated during machining is torn or separated when stress is concentrated on inclusions in the deformed steel chip, resulting in crack formation and propagation. Ca-free MnS type inclusions tend to be deformed in the direction of working, for example rolling, and many of them have an elongated form. When large elongated inclusions are present, the anisotropy in mechanical properties of a steel material increases and, in addition, the number of inclusions to serve as points for stress concentration and starting points of chipping decreases, hence no good chip disposability can be obtained. On the other hand, when there are a large number of small inclusions, the number of crack starting points in chips subjected to deformation during machining increases and, further, stress is concentrated on the inclusions and crack propagation becomes readily promotable thereby. This is presumably the cause of improvement in chip disposability.

The tool life is greatly influenced by the composition of oxides contained in the steel. When Ca is added to convert oxides to low-melting oxides, the tool life is markedly prolonged. Therefore, treatment with Ca is essential. For attaining both the above-mentioned sulfide control and oxide control simultaneously, the steelmaking conditions before and after Ca treatment were further examined in detail. As a result, the following facts were revealed. It becomes possible to control the oxide inclusions so that they may be composed of $CaO—Al_2O_3—SiO_2—TiO_2$ as main constituents even within the same composition range, by restricting the contents of those components showing a high level of interaction with oxygen in steel, such as C, Si and Mn, causing S to be contained at a specific level, reducing Al as far as possible, adding Ti and Ca each at an appropriate addition level and at an appropriate time and adjusting the level of dissolved oxygen. These oxide inclusions are low in melting point and soft and are presumably effective not only in tool life improvement owing to Ca and Ti contained therein but also in producing starting points for cracking in chips and promoting crack propagation.

The influences of the compositions with respect to C, Si, Mn and so on and of the contents of Cr, Ni, Mo, B, Nb, V and other elements, which are added for improving the strength, hardenability, metallurgical structure and other properties of steels for machine structural use, on the improvement in chip disposability and tool life as attainable by such forms of sulfide inclusions and oxide inclusions were examined. As a result, it could be confirmed that while these elements may improve the strength, hardenability and other mechanical characteristics of steels, the effect of the invention, namely the improvement in machinability with the same composition can be produced in the same manner.

Accordingly, the present inventors further established the limits to the chemical composition and to the states or forms of inclusions and, as a result, have completed the present invention. The gist of the invention is as follows.

(1) A steel for machine structural use consisting of, in percent by mass, C: 0.1–0.6%, Si: 0.01–2.0%, Mn: 0.2–2.0%, P: not more than 0.1%, S: 0.005–0.2%, Al: not more than 0.009%, Ti: not less than 0.001% but less than 0.04%, Ca: 0.0001–0.01%, O (oxygen): 0.001–0.01%, and N: not more than 0.02%, and the balance Fe and impurities, and satisfying the following relations (1) to (3) with respect to the inclusions in the steel:

$$n_0/S\ (\%) \geqq 2500 \quad (1)$$

$$n_1/n_0 \leqq 0.1 \quad (2)$$

$$n_2 \geqq 10 \quad (3)$$

wherein $n_0$, $n_1$ and $n_2$ are defined as follows:

$n_0$: total number of sulfide, having a circle equivalent diameter of not less than 1 μm, per $mm^2$ of a cross section parallel to the direction of rolling, number/$mm^2$;

$n_1$: number of MnS, having a circle equivalent diameter of not less than 1 μm and containing not less than 1.0% of Ca, per $mm^2$ of a cross section parallel to the direction of rolling, number/$mm^2$;

$n_2$: number, per $mm^2$ of a cross section parallel to the direction of rolling, of oxide inclusions having a composition comprising $CaO—Al_2O_3—Si_2—TiO_2$ and impurities, with CaO: 5–60%, $Al_2O_3$: 5–60%, $SiO_2$: 10–80% and $TiO_2$: 0.1–40% when the sum of CaO, $Al_2O_3$, $Si_2O_2$ and $TiO_2$ is taken as 100% by mass, and having a circle equivalent diameter of not less than 1 μm, number/$mm^2$.

(2) A steel for machine structural use which comprises, in addition to the components mentioned above in (1), one or more elements selected from the first group and/or second group shown below and satisfies the relations (1), (2) and (3) given above.

First group:

Cr: 0.02–2.5%, V: 0.05–0.5%, Mo: 0.05–1.0%, Nb: 0.005–0.1%, Cu: 0.02–1.0% and Ni: 0.05–2.0%;

Second group:

Se: 0.0005–0.01%, Te: 0.0005–0.01%, Bi: 0.05–0.3% and rare earth elements: 0.0001–0.0020%.

DETAILED DESCRIPTION OF THE INVENTION

Figure 1:
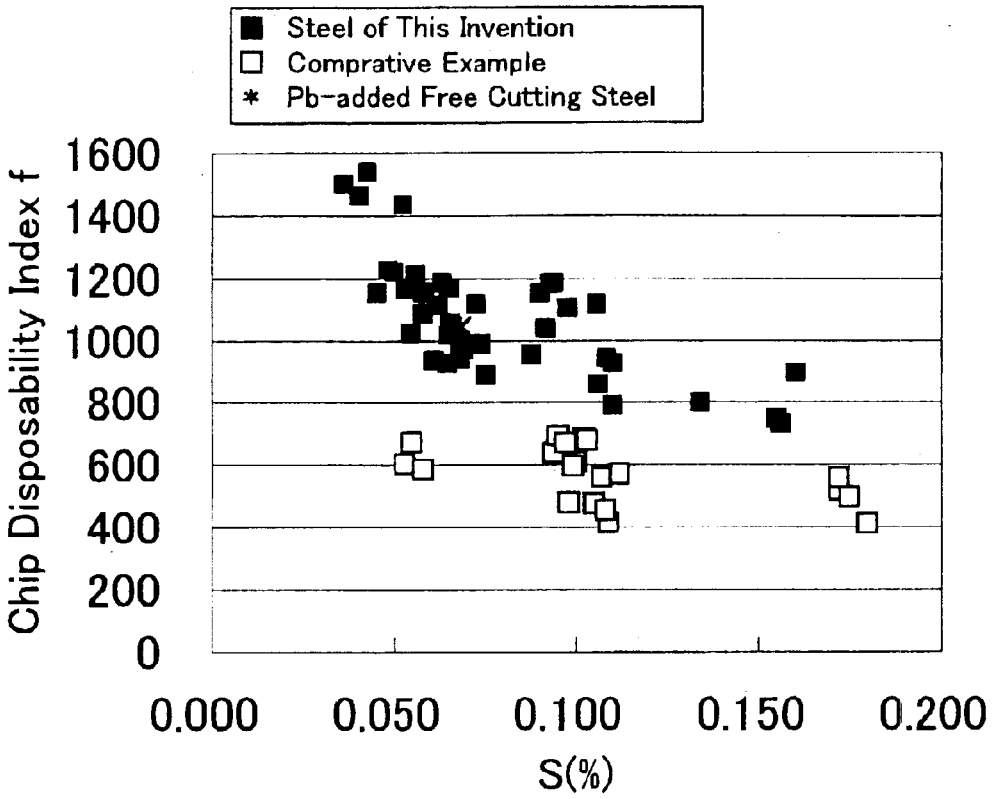
FIG. 1 is a graphic representation of the relationship between chip disposability index and S content of steel.

The grounds for the restrictions as to the inclusion distribution, chemical composition and other aspects in or of the steel of the invention are explained below. In the following description "%" referring to steel constituents means "% by mass".

The reason why only those inclusion, which have an equivalent diameter of not smaller than 1 μm as found upon substituting a circle equivalent in area for each inclusion shape observed on a cross section parallel to the direction of rolling, are taken into consideration is that those inclusions smaller than 1 μm have almost no effects on the tool life and chip disposability. Those inclusions which have a diameter exceeding 10 μm upon substitution with an equivalent circle impair the strength and other steel characteristics, prevent inclusions from being uniformly dispersed and are ineffective in improving the chip disposability, in particular, hence are undesirable.

Many of the inclusions observed on a cross section parallel to the direction of working show elongation in the direction of working or are indefinite in shape. In shape examination, the cross section of a steel sample is mirror-polished and photographed under an optical microscope at a magnification of about 400, the area of each inclusion is determined by a technique of image analysis and the area thereof is converted to that of a circle, and those inclusions having a diameter of not smaller than 1 μm alone are taken into consideration. On that occasion, when it can be judged without doubt that two or more inclusions identical in composition have been divided by rolling, they should be treated as one inclusion. The composition of each inclusion is analyzed, for example, using an EPMA (electron probe X-ray microanalyzer) or an apparatus equivalent thereto and capable of analyzing microscopic portions.

When the total number of MnS-containing inclusions, among such inclusions as mentioned above, per $mm^2$ is expressed as $n_0$ and the analytical value of S as S (%), the following relation should be satisfied:

$$n_0/S\ (\%) \geqq 2500 \quad (1)$$

When the ratio $n_0$/S (%) is below 2500, the number of inclusions becomes smaller, the characteristics as a steel material are poor and the chip disposability is also poor, when comparison is made between steels having the same S content. The number of inclusions decreases at the same S content level because individual inclusions form coarser grains. Within a range in which the relation (1) is satisfied, good chip disposability can be obtained. For further stably obtaining good chip disposability, however, the ratio $n_0$/S (%) is desirably not less than 3500. So long as the relation (1) is satisfied, $n_0$ may be large. However, when $n_0$ is excessively large, it becomes difficult to obtain such mechanical properties as tensile strength and fatigue strength as required of steels for machine structural use. Therefore, it is preferred that $n_0$ be not more than 2000, more preferably not more than 1000.

When the number of those sulfide inclusions containing not less than 1.0% by mass of Ca, among the sulfide inclusions, per $mm^2$ is expressed as $n_1$, the following relation should be satisfied:

$$n_1/n_0 \leqq 0.1 \quad (2)$$

This is because when the ratio of the number of sulfide, containing not less than 1.0 mass % Ca, to the total number of sulfide exceeds 0.1, there is a tendency toward individual inclusions becoming coarser, leading to lowered chip disposability. Within the range specified by the above formula, it is possible to make the size of sulfide inclusions in steel small. This leads to an increase in the number of sulfide inclusions containing less than 1.0 mass % Ca, whereby good chip disposability can be obtained. For further stably obtaining good chip disposability, $n_1/n_0$ is desirably not, more than 0.08. Then $n_1$ is preferably as small as possible and may be equal to 0 (zero).

The number $n_2$, per $mm^2$, of those oxide inclusions in which the total content of CaO, $Al_2O_3$, $SiO_2$ and $TiO_2$ is not less than 80 mass % and in which the contents of these four oxides are within the ranges of CaO: 5–60%, $Al_2O_3$: 5–60%, $SiO_2$: 10–80% and $TiO_2$: 0.1–40%, with the sum of them being taken as 100% by mass, among the oxide inclusions should satisfy the following relation:

$$n_2 \geqq 10 \quad (3)$$

The number of the oxide inclusions defined above should be not less than 10 because when it is less than 10, hard oxides having a composition of high melting point, such as $Al_2O_3$, are formed in addition to oxides having a composition of low melting point, which are formed by addition of Ca and Ti, and accordingly, no tool life prolonging effect can be obtained.

The reason why the ranges of the contents of the oxides in the inclusions are respectively restricted is that the oxides have a low melting point in these composition ranges. Within this restricted composition range, these oxides become soft with the increasing temperature during cutting and, therefore, the oxides will not promote the wear of the tool but contribute to the prolongation of the tool life. Outside this composition range, the melting points of the oxides rise and the hardness thereof increases, and the oxides thus promote the wear of the tool, hence the tool life is shortened.

For causing the inclusions in steel to be in such a state or form as mentioned above and for attaining those mechanical characteristics and machinability required of steels for machine structural use, the contents of the components to be contained in the steel must be restricted as mentioned below.

The content of C should be 0.1–0.6%. C is an important element governing the properties relating to the strength of steels, and the content thereof is generally selected taking the mechanical properties into consideration. When the C content is below 0.1%, the mechanical properties required of crankshafts and other automotive mechanical parts cannot be obtained. On the other hand, when it exceeds 0.6%, the tool life is markedly shortened and the desired machinability can hardly be obtained. For obtaining those mechanical properties, hardness and toughness, fatigue strength and machinability which are required of crankshafts and other automotive mechanical parts, it is desirable that the C content be 0.30–0.55%.

The content of Si should be 0.01–2.0%. Si is an element essential for attaining the oxide composition according to the invention, and it is contained also for the purpose of deoxidizing molten steel. At a content below 0.01%, the desired oxide composition cannot be obtained. At levels exceeding 2.0%, its effects saturate and, furthermore, a decrease in toughness of steel is caused. Therefore, the Si content should be 0.01–2.0%. A more preferred Si content range for stably obtaining the desired oxide composition, without deteriorating the mechanical characteristics, is 0.15–1.0%.

The content of Mn should be 0.2–2.0%. Mn is an important element for forming sulfide inclusions greatly effective in improving the machinability. It has a molten steel deoxidizing effect as well. In addition, when S is caused to be contained for improving the machinability, Mn is effective in preventing hot workability of steel materials from deteriorating and, for producing this effect, a content thereof not less than 0.2% is essential. At levels exceeding 2.0%, however, resistance to cutting increases. Thus, the Mn content should be 0.2–2.0%. In the case of steels to be used after heat treatment, Mn is an element greatly contributing to the hardenability, and the content for that purpose is appropriately selected within the above range. On that occasion, a more preferred Mn content range is 0.4–1.70%.

The content of S should be 0.005–0.2%. S is necessary for improving the machinability. It binds with Mn etc. and forms sulfide inclusions. The sulfide inclusion, MnS, readily changes its shape in the process of steel solidification due to the addition of Ca and Ti and, therefore, the shape of the MnS type sulfide inclusions is specified simultaneously according to the present invention. At a content below 0.005%, no machinability improving effect is obtained and, at an excessively high content, the hot workability and toughness of steel deteriorate. Therefore, its content should be within the range of 0.005–0.2%. Within this range, good machinability and mechanical properties can be obtained. For attaining both appropriate mechanical characteristics and good machinability of steels for machine structural use after heat treatment, for instance, the S content is desirably 0.03–0.12%.

The content of Al (sol. Al, namely acid-soluble Al) should be not more than 0.009%. Al has a great deoxidizing effects of molten steel and is added for adjusting the level of deoxidation. However, $Al_2O_3$, which is formed as a result of deoxidation, is hard and shortens the tool life and, therefore, the upper limit for Al is set at 0.009% for avoiding an increase of $Al_2O_3$ content.

Within this range, the frequency of formation of $Al_2O_3$ itself and oxides whose main component is $Al_2O_3$ can be reduced. A small amount of Al as a deoxidizer, which is used for rapid reduction in oxygen content at the initial stage of steelmaking, or Al inevitably coming from raw material such as ferro alloy will not cause any problem since such Al is mostly used for the formation of $CaO—Al_2O_3—SiO_2—TiO_2$ oxides. Therefore, the Al content should be not more than 0.009%, without necessity for setting any particular lower limit. For more stable formation of the above mentioned oxide, the Al content is desirably not more than 0.005%.

The content of Ti should be not less than 0.001% but less than 0.04%. Ti is effective in stably forming oxides comprising $CaO—Al_2O_3—SiO_2—TiO_2$ and making them finer and, therefore, is an element essential in the steel of the invention. While those low-melting point oxides favorably influencing the machinability can also be formed in $CaO—Al_2O_3—SiO_2$ system without Ti, the effects are enhanced when $TiO_2$ is contained in the oxide. When the Ti content is below 0.001%, those effects will not be produced. At levels of 0.04% or more, not only do the effects reach a point of saturation but also the precipitation of hard TiN increases, reducing the tool life. A more preferred Ti content for stably forming oxides favorable for the machinability is within the range of 0.005–0.025%.

The Ca content should be 0.0001–0.01%. Ca is effective in improving the tool life and is necessary for the formation of oxides comprising $CaO—Al_2O_3—SiO_2—TiO_2$, which are effective in improving the machinability. Below 0.0001%, such effects are not produced to a satisfactory extent. On the other hand, at levels exceeding 0.01%, the above-mentioned oxide can no more be formed and, in addition, the cost of production increases since the efficiency of addition of Ca is low. In addition, the amount of MnS containing Ca as solid solution increases and MnS becomes coarse. Thus, the number of MnS inclusions decreases and the desired chip disposability improving and other effects cannot be obtained. A more preferred Ca content for more stably attaining the condition of inclusions as defined in accordance with the invention is within the range of 0.0005–0.005%. For attaining the condition or form of inclusions which is defined herein and suited for machinability improvement, the steelmaking conditions before and after addition of Ca should be taken into consideration.

The content of O (oxygen) should be 0.001–0.01%. Oxygen is an important element for the formation of $CaO—Al_2O_3—SiO_2—TiO_2$ oxides favorable for machinability improvement and for attaining the form and number of sulfide inclusions, which are favorable for machinability improvement. At a level below 0.001%, such effects are not sufficient but it becomes rather difficult to obtain oxide inclusions in those forms favorable for machinability improvement. On the other hand, at content levels exceeding 0.01%, sulfide inclusions, including MnS and so forth, become coarse and, in addition, the amount of oxide inclusions increases, leading to deterioration of not only machinability but also steel material characteristics, such as a decrease in toughness. For more certainly and stably obtaining those forms of inclusions that are defined herein, the oxygen content is desirably not more than 0.005%.

The forms of sulfide inclusions and the composition of oxide inclusions, which serve to improve the chip disposability and prolong the tool life, are controlled in the process of steelmaking, so that it is important to control of the steelmaking process.

An example of the melting procedure for obtaining the forms and composition of inclusions as defined herein is given and explained below. However, the method of producing the steels according to the invention should not be limited to the method of production described hereinafter.

First, molten steel containing a small amount of carbon is subjected, in a state of a low Al content, to vacuum treatment, for instance, for adjusting the excess oxygen content. Then, the contents of the main elements C, Si, Mn and S and other elements are adjusted to the respective intended levels and then the dissolved oxygen content is preliminarily adjusted. On that occasion, Al may be added for adjusting the dissolved oxygen content, if necessary. The Al content resulting from this addition should be not more than 0.009%, preferably not more than 0.005%, as mentioned hereinabove. Thereafter, Ti is added and the molten steel is finally treated with Ca, followed by casting to give ingots or blooms.

The reason why the production method according to the above procedure is desirable is as mentioned below.

When the excess oxygen is removed from the molten steel containing a small amount of carbon, the oxides formed by deoxidation by Mn and Si added on the occasion of adjusting the contents of the main components become the oxides not containing excess $Al_2O_3$ as compared with the case where Al is added. In composition adjustment, it is necessary to make adjustments so that the amount of dissolved oxygen may not become too low due to deoxidizing reactions of C, Mn and Si. The purpose of the dissolved oxygen level adjustment is to cause Ca added before casting to form the oxide to thereby prevent the formation of Ca-based sulfides capable of causing the formation of MnS containing Ca as a solute. Then, in some cases, Al is added for adjusting the dissolved oxygen content, if necessary. However, excess amounts of $Al_2O_3$ type oxides are not formed because the Al addition is made in a minimum necessary amount after the oxygen concentration and the composition of oxide inclusions have already been adjusted. Nevertheless, the presence of $Al_2O_3$ causes a reduction in tool life, so that the Al content at that stage is required to be not more than 0.009%, more desirably not more than 0.005%.

Then, Ti is added, whereupon deoxidation further proceeds. The formed oxide of Ti combines with already existing oxides to give thermodynamically more stable forms, which are effective in preventing the formation of large inclusions and uniformly dispersing inclusions about 1 to 10 $\mu$m in size. The subsequent treatment with Ca is made by adding calcium-silicon or ferro alloy. Ca is hardly soluble in molten steel and reacts with oxygen in the molten steel and with oxides dispersed therein, whereby CaO—$Al_2O_3SiO_2$—$TiO_2$ oxides are formed.

In accordance with one aspect of the invention, the steel for machine structural use comprises the above-mentioned components, with the balance being Fe and impurities. The following upper limits are set to the contents of P and N among the impurities.

P: not more than 0.1%

P is an element appearing in steel as an impurity. It has a solid solution strengthening effect and a hardenability improving effect. However, it deteriorates the toughness of steel, so that the range of not more than 0.1% is selected as a range in which the adverse effect is not so significant. Its content is desirably not more than 0.05%, and the less, the better.

N: not more than 0.02%

N, when it coexists with Al, forms fine nitride, effectively making steel crystal finer. However, in accordance with the invention, the Al content in steel is restricted to a low level, hence such effects cannot be expected. Rather, N binds to the above-mentioned Ti to form TiN, which may possibly deteriorate the tool life. Therefore, it is desirable that its content be as low as possible. At levels not more than 0.02%, the adverse effects are produced only to a slight extent. Hence, the allowable upper limit is set at 0.02%. A more preferred range is not more than 0.015%.

In accordance with another aspect of the invention, the steel for machine structural use comprises, in addition to the components mentioned above, one or more components selected from the first group and/or the second group given below.

First group: Cr: 0.02–2.5%, V: 0.05–0.5%, Mo: 0.05–1.0%, Nb: 0.005–0.1%, Cu: 0.02–1.0% and Ni: 0.05–2.0%;

Second group: Se: 0.0005–0.01%, Te: 0.0005–0.01%, Bi: 0.05–0.3% and rare earth elements: 0.0001–0.0020%.

The components belong to the above first group all contribute to improvements in strength of steels. The components belonging to the second group contribute to improvements in machinability of steels. The contents of these elements are restricted for the following reasons.

Cr: 0.02–2.5%

Cr is effective in improving the hardenability of steels and is preferably added in alloy steels for machine structural use. A content of not less than 0.02% is preferred for the purpose of improving the hardenability but, at levels exceeding 2.5%, the hardenability becomes excessively high, lowering the endurance ratio and yield ratio and further deteriorating the machinability. Therefore, the Cr content should be 0.02–2.5%.

Mo: 0.05–1.0%

Mo is effective in making the ferrite-pearlite structure finer and, when heat refining is carried out, it is effective in improving the hardenability and toughness. For securing such effects, its content is desirably not less than 0.05%. However, at levels exceeding 1.0%, the effects reach a point of saturation and the fatigue strength may rather be reduced. Further, the cost increases. Therefore, the Mo content should be 0.05–1.0%.

Ni: 0.05–2.0%

Ni is effective in improving the strength of steels through solid solution strengthening and also in improving the hardenability and/or toughness. For securing such effects, it is desirable that its content be not less than 0.05%. At a level exceeding 2.0%, however, the above effects reach a point of saturation and, in addition, the hot-workability deteriorates. Therefore, an appropriate content of Ni is 0:05–2.0%.

Cu: 0.02–1.0%

Cu is effective in improving the hardenability of steels. When such effect is desired, it is recommended that Cu be contained at a level of not less than 0.02%. Furthermore, it is effective in improving the strength of steels through precipitation strengthening and, for producing this effect, its content of not less than 0.1% is desirable. However, at a content level exceeding 1.0%, deterioration in hot workability may be induced or the Cu-containing precipitates become coarse, whereby the above effects are lost. Therefore, the Cu content should be 0.02–1.0%.

V: 0.05–0.5%, Nb: 0.005–0.1%

V and Nb precipitate as fine nitrides or carbonitrides and thus improve the strength of steels. For securing this effect, it is desirable that the V content be not less than 0.05% and the Nb content not less than 0.005%. However, at V content exceeding 0.5% or Nb content exceeding 0.1%, not only the above effect reaches a point of saturation but also the nitrides and carbides are formed in excessive amounts, whereby the machinability of steels deteriorates and the toughness also decreases. Therefore, the V content should be 0.05–0.5% and the Nb content 0.005–0.1%.

Se: 0.0005–0.01%, Te: 0.0005–0.01%

Se and Te react with Mn to form MnSe and MnTe, respectively, and improve the machinability of steels. For producing this effect, the contents of Se and Te are each desirably not less than 0.0005%. At content levels of Se and Te exceeding 0.01%, however, that effect reaches a point of saturation and the hot workability is rather deteriorated. Therefore, an appropriate Se content and an appropriate Te content are 0.0005–0.01% respectively.

Bi: 0.05–0.3%

Bi improves the machinability of steels. This is presumably due to its formation of low-melting point inclusions and its lubricating effect in the step of machining, like Pb. For securing that effect, its content is recommendably not less than 0.05%. However, when it exceeds 0.3%, not only the effect reaches a point of saturation but also the hot workability is worsened. Therefore, an appropriate content of Bi is within the range of 0.05–0.3%.

Rare earth elements: 0.0001–0.0020%

When rare earth elements are contained in steels, they form inclusions including sulfides and increase the number of sulfide inclusions, so that an machinability improving effect is obtained. The rare earth elements such as La, Ce and Nd, and others are called "REM". Mischmetal may also be used for adding rare earth elements. When one or more of rare earth elements is added at a level of not less than 0.0001%, the above effect is produced. For obtaining the effect with more certainty, they are desirably added at a level of not less than 0.0005%. At a level above 0.0020%, however, the proportion of oxides and/or sulfides containing rare earth elements increases; accordingly, the desired inclusion form cannot be obtained, hence the machinability cannot be improved. Therefore, an appropriate content of rare earth elements is within the range of 0.0001–0.0020%.

EXAMPLE

Steels having the respective chemical compositions shown in Table 1 and Table 2 were melted and cast to give 150 kg ingots. Some steels shown in Table 2 were melted by the procedure to be mentioned later herein. In Table 2, the steels Nos. 74 and 75 are Pb-containing steels.

(1) Each molten steel, in a state containing a small amount of carbon, was subjected to vacuum treatment for excess oxygen adjustment in a low Al content state.

(2) Then, the furnace inside was adjusted to an argon atmosphere and, thereafter, the main components C, Si, Mn and S and other elements were adjusted to the desired levels and, at the same time, iron oxide was added, if necessary, to adjust the dissolved oxygen content. Then, Al was added, if necessary, for further adjustment of the dissolved oxygen content.

(3) Thereafter, Ti was added and, after the final treatment with Ca, the melt was cast to give ingots or blooms.

The steels shown in Table 1 are steels falling within the composition range defined in accordance with the present invention. The steels shown in Table 2 are steels failing to fall within that composition range.

Among the steels shown in Table 2, those steels differing in the form of inclusions from the steels of the invention were melted in the following manner, even when they were within the same composition range. Thus, in melting those having a high oxygen content; the vacuum treatment in a state containing a small amount of carbon was omitted or iron oxide was added in excess for adjusting the dissolved oxygen content in the intermediate stage. In melting those having a high Al concentration, Al was added at the stage of adjusting the main components. In cases where further sufficient deoxidation was carried out, Al was added for deoxidation immediately before the addition of Ca, which was performed in the conventional manner, according to the chemical analysis and the like. For those steels for which no further deoxidation with Al was conducted, the dissolved oxygen level adjustment by addition of iron oxide or the like was not carried out after the deoxidation with C, Si and Mn, but Ti and Ca were added immediately before casting.

In this process of melting, the excess Ca, which does not contribute to the deoxidation reaction, forms CaS in the molten steel stage because of its high affinity for S and the CaS serves as nuclei for the formation of MnS which crystallizes out subsequently As a result, in cases where the excess Ca, which does not contribute to the deoxidation reaction, is contained in a state after sufficient deoxidation, it forms CaS in the molten steel and MnS crystallizes out utilizing the CaS as nuclei for the formation of MnS. Therefore, the number ($n_1$) of MnS inclusions containing not less than 1% of Ca as a solute increases and the left term "$n_1/n_0$" of the formula (2) exceeds 0.1. As a result, sulfide coarsening is caused and the total number ($n_0$) of inclusions decreases. Therefore, the relation (1), namely "$n_0$/S (%)≧2500" is not satisfied, hence the desired chip disposability cannot be obtained.

Each steel ingot was heated at 1250° C. and then hot-forged at temperatures up to 1000° C. to give a round bar with a diameter of 70 mm and, after forging, the bar was air-cooled to room temperature. Test specimens were taken from the thus-obtained round bar at a site of 17.5 mm deep from the bar surface, namely at a site half the radius of the round bar, the cross section of each specimen parallel to the direction of working was mirrorpolished and observed at a magnification of 400 using an EPMA in not less than 20 fields of view per specimen, and those sulfide and oxide inclusions not less than 1 μm in circle equivalent diameter (diameter of a circle equal in area to the grain) were counted. Then, not less than ten sulfide and oxide inclusions randomly selected for each field of view were quantitatively analyzed and the compositions thereof were determined.

TABLE 1

| No | Chemical Composition (mass %, Fe: bal.) | | | | | | | | | | |
|---|---|---|---|---|---|---|---|---|---|---|---|
| | C | Si | Mn | P | S | Ti | sol. Al | Ca | O | N | |
| Steel of This Invention | | | | | | | | | | | |
| 1 | 0.39 | 0.26 | 0.52 | 0.008 | 0.045 | 0.018 | 0.005 | 0.0023 | 0.0031 | 0.0057 | |
| 2 | 0.38 | 0.21 | 0.55 | 0.016 | 0.048 | 0.020 | 0.002 | 0.0021 | 0.0031 | 0.0084 | |
| 3 | 0.38 | 0.20 | 0.57 | 0.018 | 0.050 | 0.007 | 0.003 | 0.0013 | 0.0024 | 0.0144 | |
| 4 | 0.41 | 0.21 | 1.25 | 0.012 | 0.053 | 0.018 | 0.003 | 0.0017 | 0.0021 | 0.0110 | |
| 5 | 0.50 | 0.20 | 0.79 | 0.013 | 0.056 | 0.003 | 0.002 | 0.0025 | 0.0029 | 0.0123 | |
| 6 | 0.40 | 0.22 | 0.59 | 0.025 | 0.058 | 0.020 | 0.003 | 0.0011 | 0.0017 | 0.0102 | |
| 7 | 0.36 | 0.25 | 0.79 | 0.021 | 0.068 | 0.035 | 0.002 | 0.0014 | 0.0038 | 0.0076 | |
| 8 | 0.47 | 0.19 | 1.15 | 0.025 | 0.074 | 0.021 | <0.002 | 0.0017 | 0.0025 | 0.0102 | |
| 9 | 0.43 | 0.19 | 1.52 | 0.022 | 0.075 | 0.035 | 0.002 | 0.0024 | 0.0035 | 0.0094 | |
| 10 | 0.41 | 0.17 | 1.21 | 0.016 | 0.106 | 0.007 | 0.007 | 0.0018 | 0.0032 | 0.0114 | |
| 11 | 0.44 | 0.17 | 1.26 | 0.016 | 0.108 | 0.008 | 0.002 | 0.0030 | 0.0030 | 0.0120 | |
| 12 | 0.55 | 0.25 | 1.24 | 0.020 | 0.160 | 0.006 | 0.003 | 0.0015 | 0.0024 | 0.0095 | |
| 13 | 0.53 | 0.21 | 0.74 | 0.013 | 0.058 | 0.019 | 0.002 | 0.0025 | 0.0029 | 0.0111 | Cr: 0.10 |
| 14 | 0.38 | 0.53 | 1.45 | 0.015 | 0.061 | 0.007 | 0.001 | 0.0018 | 0.0029 | 0.0135 | Cr: 0.14 |
| 15 | 0.39 | 0.55 | 1.50 | 0.016 | 0.065 | 0.006 | 0.002 | 0.0012 | 0.0023 | 0.0141 | Cr: 0.12 |
| 16 | 0.52 | 0.17 | 0.74 | 0.022 | 0.069 | 0.004 | <0.002 | 0.0016 | 0.0038 | 0.0124 | Cr: 0.09 |
| 17 | 0.35 | 0.17 | 1.28 | 0.018 | 0.092 | 0.006 | 0.002 | 0.0012 | 0.0033 | 0.0130 | Cr: 0.20 |
| 18 | 0.41 | 0.20 | 1.29 | 0.018 | 0.093 | 0.002 | 0.002 | 0.0034 | 0.0036 | 0.0145 | Cu: 0.02 |
| 19 | 0.47 | 0.25 | 1.40 | 0.020 | 0.068 | 0.008 | 0.001 | 0.0019 | 0.0027 | 0.0124 | Ni: 0.10 |
| 20 | 0.42 | 0.24 | 1.23 | 0.029 | 0.065 | 0.020 | 0.004 | 0.0019 | 0.0028 | 0.0108 | Nb: 0.05 |
| 21 | 0.42 | 0.22 | 1.26 | 0.010 | 0.098 | 0.005 | 0.002 | 0.0029 | 0.0035 | 0.0082 | Nb: 0.10 |
| 22 | 0.41 | 0.20 | 1.18 | 0.022 | 0.072 | 0.021 | 0.004 | 0.0013 | 0.0020 | 0.0110 | Mo: 0.10 |
| 23 | 0.37 | 0.25 | 1.29 | 0.013 | 0.094 | 0.032 | 0.002 | 0.0024 | 0.0026 | 0.0087 | Mo: 0.10 |
| 24 | 0.45 | 0.18 | 1.16 | 0.021 | 0.156 | 0.017 | 0.002 | 0.0020 | 0.0029 | 0.0107 | V: 0.10 |
| 25 | 0.41 | 0.46 | 0.75 | 0.016 | 0.036 | 0.010 | 0.002 | 0.0016 | 0.0029 | 0.0148 | Cr: 0.10, V: 0.07 |
| 26 | 0.48 | 0.27 | 1.42 | 0.019 | 0.065 | 0.007 | 0.002 | 0.0017 | 0.0025 | 0.0105 | Cr: 0.10, V: 0.10 |
| 27 | 0.40 | 0.18 | 1.24 | 0.014 | 0.110 | 0.011 | <0.002 | 0.0011 | 0.0029 | 0.0128 | Cr: 0.25, V: 0.10 |
| 28 | 0.39 | 0.17 | 1.22 | 0.014 | 0.106 | 0.024 | <0.002 | 0.0030 | 0.0041 | 0.0119 | Ni: 0.14, Cr: 0.25, V: 0.09 |
| 29 | 0.43 | 0.20 | 1.17 | 0.017 | 0.042 | 0.026 | 0.003 | 0.0020 | 0.0025 | 0.0080 | Se: 0.0025 |
| 30 | 0.38 | 0.20 | 1.20 | 0.018 | 0.055 | 0.018 | 0.003 | 0.0015 | 0.0025 | 0.0078 | Te: 0.0020 |
| 31 | 0.40 | 0.22 | 1.24 | 0.023 | 0.088 | 0.030 | <0.002 | 0.0020 | 0.0030 | 0.0087 | REM: 0.0009 |
| 32 | 0.43 | 0.21 | 1.30 | 0.020 | 0.090 | 0.004 | 0.003 | 0.0023 | 0.0027 | 0.0079 | Se: 0.005 |
| 33 | 0.40 | 0.22 | 1.17 | 0.011 | 0.155 | 0.020 | 0.002 | 0.0013 | 0.0018 | 0.0085 | Bi: 0.07 |
| 34 | 0.46 | 0.20 | 1.23 | 0.021 | 0.040 | 0.024 | 0.003 | 0.0016 | 0.0022 | 0.0081 | Cr: 0.08, Bi: 0.05 |
| 35 | 0.42 | 0.18 | 1.15 | 0.024 | 0.052 | 0.023 | 0.003 | 0.0021 | 0.0034 | 0.0116 | V: 0.09, Bi: 0.07 |
| 36 | 0.45 | 0.19 | 1.24 | 0.026 | 0.062 | 0.020 | <0.002 | 0.0014 | 0.0019 | 0.0079 | Cr: 0.10, Te: 0.0035 |
| 37 | 0.45 | 0.22 | 1.21 | 0.024 | 0.063 | 0.030 | 0.003 | 0.0011 | 0.0014 | 0.0076 | V: 0.10, Te: 0.0020, REM: 0.0009 |
| 38 | 0.39 | 0.22 | 1.16 | 0.015 | 0.065 | 0.015 | 0.002 | 0.0013 | 0.0019 | 0.0075 | Cr: 0.10, REM: 0.0010 |
| 39 | 0.46 | 0.17 | 1.16 | 0.028 | 0.110 | 0.019 | 0.004 | 0.0017 | 0.0028 | 0.0096 | Cu: 0.04, Bi: 0.08 |
| 40 | 0.37 | 0.21 | 1.19 | 0.013 | 0.134 | 0.034 | 0.003 | 0.0015 | 0.0020 | 0.0104 | Bi: 0.09, REM: 0.0011 |

TABLE 2

| No | Chemical Composition (mass %, Fe: bal.) | | | | | | | | | | |
|---|---|---|---|---|---|---|---|---|---|---|---|
| | C | Si | Mn | P | S | Ti | sol. Al | Ca | O | N | |
| Comparative Example | | | | | | | | | | | |
| 41 | 0.50 | 0.19 | 0.81 | 0.015 | 0.053 | 0.007 | 0.003 | 0.0020 | 0.0015 | 0.0105 | |
| 42 | 0.53 | 0.20 | 0.76 | 0.014 | 0.058 | 0.003 | 0.002 | 0.0033 | 0.0041 | 0.0116 | |
| 43 | 0.48 | 0.22 | 1.25 | 0.010 | 0.055 | 0.008 | 0.002 | 0.0020 | 0.0055 | 0.0115 | |
| 44 | 0.45 | 0.21 | 1.34 | 0.020 | 0.098 | 0.015 | 0.003 | 0.0031 | 0.0010 | 0.0111 | |
| 45 | 0.39 | 0.24 | 1.26 | 0.020 | 0.099 | 0.010 | 0.005 | 0.0018 | 0.0019 | 0.0107 | |
| 46 | 0.42 | 0.21 | 1.20 | 0.018 | 0.095 | 0.009 | 0.003 | 0.0022 | 0.0049 | 0.0112 | |
| 47 | 0.43 | 0.22 | 1.26 | 0.019 | 0.094 | 0.008 | 0.002 | 0.0018 | 0.0054 | 0.0123 | |
| 48 | 0.44 | 0.19 | 1.25 | 0.014 | 0.102 | 0.008 | 0.002 | 0.0027 | 0.0025 | 0.0125 | |
| 49 | 0.42 | 0.18 | 1.21 | 0.018 | 0.109 | 0.005 | 0.004 | 0.0025 | 0.0021 | 0.0110 | |
| 50 | 0.36 | 0.60 | 1.46 | 0.015 | 0.172 | 0.010 | <0.002 | 0.0030 | 0.0021 | 0.0160 | |
| 51 | 0.39 | 0.65 | 1.44 | 0.015 | 0.175 | 0.011 | <0.002 | 0.0030 | 0.0031 | 0.0170 | |
| 52 | 0.40 | 0.30 | 1.10 | 0.018 | 0.095 | 0.020 | 0.008 | 0.0035 | 0.0025 | 0.0106 | V: 0.10 |
| 53 | 0.42 | 0.22 | 1.20 | 0.016 | 0.097 | 0.009 | 0.002 | 0.0025 | 0.0020 | 0.0098 | Cr: 0.10 |
| 54 | 0.45 | 0.20 | 1.19 | 0.016 | 0.100 | 0.015 | 0.007 | 0.0030 | 0.0025 | 0.0111 | Mo: 0.10 |
| 55 | 0.46 | 0.25 | 1.14 | 0.013 | 0.103 | 0.007 | 0.002 | 0.0021 | 0.0020 | 0.0104 | Cu: 0.03 |
| 56 | 0.38 | 0.16 | 1.24 | 0.019 | 0.105 | 0.015 | 0.004 | 0.0026 | 0.0018 | 0.0100 | Te: 0.0014 |
| 57 | 0.36 | 0.27 | 1.19 | 0.024 | 0.107 | 0.018 | 0.003 | 0.0024 | 0.0018 | 0.0105 | Mg: 0.0010 |
| 58 | 0.45 | 0.21 | 1.16 | 0.018 | 0.112 | 0.020 | 0.006 | 0.0013 | 0.0010 | 0.0099 | REM: 0.0008 |

TABLE 2-continued

| No | Chemical Composition (mass %, Fe: bal.) | | | | | | | | | | |
|---|---|---|---|---|---|---|---|---|---|---|---|
| | C | Si | Mn | P | S | Ti | sol. Al | Ca | O | N | |
| 59 | 0.38 | 0.64 | 1.38 | 0.015 | 0.180 | 0.012 | <0.002 | 0.0030 | 0.0024 | 0.0135 | Cr: 0.18, V: 0.14 |
| 60 | 0.38 | 0.18 | 1.22 | 0.014 | 0.099 | 0.008 | <0.002 | 0.0033 | 0.0021 | 0.0108 | Ni: 0.15, Cr: 0.25, V: 0.09 |
| 61 | 0.37 | 0.20 | 1.20 | 0.020 | 0.172 | 0.006 | <0.002 | 0.0025 | 0.0017 | 0.0133 | Cu: 0.11, Ni: 0.06, Cr: 0.19, Mo: 0.03, V: 0.12 |
| 62 | 0.45 | 0.005* | 1.15 | 0.018 | 0.108 | 0.007 | <0.002 | 0.0021 | 0.0095 | 0.0108 | |
| 63 | 0.51 | 0.17 | 0.81 | 0.013 | 0.002* | 0.008 | 0.004 | 0.0030 | 0.0040 | 0.0080 | |
| 64 | 0.40 | 0.19 | 2.10* | 0.016 | 0.101 | 0.026 | <0.002 | 0.0035 | 0.0053 | 0.0115 | |
| 65 | 0.85* | 0.18 | 1.15 | 0.015 | 0.099 | 0.018 | <0.002 | 0.0029 | 0.0038 | 0.0125 | |
| 66 | 0.52 | 0.19 | 0.92 | 0.019 | 0.054 | 0.032 | 0.020* | 0.0027 | 0.0010 | 0.0134 | |
| 67 | 0.50 | 0.24 | 1.26 | 0.017 | 0.106 | 0.025 | 0.010* | 0.0003 | 0.0019 | 0.0111 | |
| 68 | 0.38 | 0.22 | 1.22 | 0.012 | 0.180 | 0.002 | <0.002 | <0.0001* | 0.0016 | 0.0094 | |
| 69 | 0.40 | 0.21 | 1.19 | 0.025 | 0.104 | 0.009 | 0.035* | 0.0020 | 0.0025 | 0.0101 | |
| 70 | 0.42 | 0.19 | 1.26 | 0.021 | 0.095 | 0.011 | 0.030* | 0.0012 | 0.0019 | 0.0115 | |
| 71 | 0.46 | 0.18 | 1.22 | 0.017 | 0.097 | 0.013 | 0.020* | 0.0017 | 0.0020 | 0.0107 | |
| 72 | 0.45 | 0.20 | 1.25 | 0.020 | 0.098 | 0.005 | 0.040* | 0.0014 | 0.0020 | 0.0105 | |
| 73 | 0.48 | 0.13 | 1.24 | 0.015 | 0.116 | <0.001* | 0.003 | 0.0029 | 0.0025 | 0.0127 | |
| 74 | 0.50 | 0.25 | 1.20 | 0.020 | 0.060 | 0.001 | 0.002 | 0.0018 | 0.0024 | 0.0090 | Pb: 0.13* |
| 75 | 0.46 | 0.45 | 1.00 | 0.020 | 0.068 | 0.004 | <0.002 | 0.0015 | 0.0025 | 0.0085 | Pb: 0.15* |

Based on the thus-found total number ($n_0$) of sulfide inclusions per unit specimen area (1 $mm^2$) and the result of analysis for S, "$n_0$/S (%)" was calculated. Then, the number of those sulfide inclusions containing not less than 1.0 mass % of Ca was determined, and "$n_1/n_0$" was calculated.

For the oxide inclusions analyzed in the above manner, the number ($n_2$) of those oxide inclusions in which the sum of the constituents CaO, $Al_2O_2$, $Si_2$ and $TiO_2$ accounted for not less than 80% by mass, with CaO: 5–60%, $Al_2O_3$: 5–60%, $SiO_2$: 10–80% and $TiO_2$: 0.1–40% when the sum of CaO, $Al_2O_3$, $Si_2$ and $TiO_2$ was taken as 100% by mass was determined. The results of these examinations as to inclusions are summarized in Table 3 and Table 4. Mark "*" in Table 4 indicates values not satisfying the conditions of this invention or not reaching aimed properties.

TABLE 3

| No | $n_0$ (number/$mm^2$) | $n_0$/S (%) | $n_1$ (number/$mm^2$) | $n_1/n_0$ | $n_2$ (number/$mm^2$) | Chip Disposability Index f | Tool Life (Number of Drillings) |
|---|---|---|---|---|---|---|---|
| Steel of This Invention | | | | | | | |
| 1 | 258 | 5733 | 13 | 0.050 | 18 | 1156 | 81 |
| 2 | 244 | 5072 | 11 | 0.045 | 17 | 1226 | 82 |
| 3 | 245 | 4900 | 7 | 0.029 | 17 | 1220 | 98 |
| 4 | 287 | 5398 | 10 | 0.035 | 12 | 1166 | 85 |
| 5 | 321 | 5732 | 13 | 0.040 | 26 | 1214 | 125 |
| 6 | 254 | 4379 | 10 | 0.039 | 15 | 1155 | 92 |
| 7 | 365 | 5368 | 31 | 0.085 | 24 | 941 | 125 |
| 8 | 378 | 5121 | 16 | 0.042 | 14 | 989 | 87 |
| 9 | 349 | 4629 | 24 | 0.069 | 27 | 889 | 97 |
| 10 | 460 | 4355 | 9 | 0.019 | 12 | 1119 | 107 |
| 11 | 472 | 4362 | 18 | 0.038 | 20 | 944 | 116 |
| 12 | 536 | 3350 | 8 | 0.015 | 24 | 894 | 155 |
| 13 | 319 | 5502 | 8 | 0.025 | 35 | 1086 | 137 |
| 14 | 229 | 3754 | 14 | 0.061 | 15 | 934 | 89 |
| 15 | 284 | 4369 | 13 | 0.046 | 12 | 1015 | 101 |
| 16 | 283 | 4099 | 15 | 0.053 | 16 | 971 | 116 |
| 17 | 509 | 5542 | 4 | 0.008 | 24 | 1039 | 116 |
| 18 | 532 | 5720 | 12 | 0.023 | 19 | 1183 | 132 |
| 19 | 255 | 3750 | 11 | 0.043 | 14 | 1000 | 94 |
| 20 | 310 | 4793 | 13 | 0.042 | 13 | 928 | 94 |
| 21 | 582 | 5958 | 13 | 0.023 | 19 | 1106 | 115 |
| 22 | 335 | 4629 | 10 | 0.030 | 18 | 1119 | 99 |
| 23 | 558 | 5947 | 19 | 0.034 | 16 | 1186 | 124 |
| 24 | 571 | 3660 | 18 | 0.032 | 21 | 731 | 127 |
| 25 | 219 | 6083 | 16 | 0.073 | 19 | 1500 | 84 |
| 26 | 320 | 4923 | 15 | 0.047 | 15 | 1169 | 85 |
| 27 | 423 | 3850 | 15 | 0.035 | 22 | 927 | 125 |
| 28 | 604 | 5697 | 8 | 0.013 | 14 | 858 | 129 |
| 29 | 259 | 6128 | 20 | 0.077 | 18 | 1538 | 89 |
| 30 | 262 | 4787 | 7 | 0.027 | 21 | 1023 | 102 |
| 31 | 465 | 5288 | 12 | 0.026 | 25 | 955 | 107 |
| 32 | 573 | 6340 | 11 | 0.019 | 32 | 1153 | 116 |

TABLE 3-continued

| No | $n_0$ (number/mm$^2$) | $n_0$/S (%) | $n_1$ (number/mm$^2$) | $n_1/n_0$ | $n_2$ (number/mm$^2$) | Chip Disposability Index f | Tool Life (Number of Drillings) |
|---|---|---|---|---|---|---|---|
| 33 | 529 | 3413 | 6 | 0.011 | 19 | 748 | 125 |
| 34 | 235 | 5826 | 7 | 0.030 | 24 | 1463 | 80 |
| 35 | 268 | 5123 | 8 | 0.030 | 24 | 1434 | 98 |
| 36 | 310 | 5005 | 11 | 0.035 | 14 | 1114 | 89 |
| 37 | 369 | 5838 | 16 | 0.043 | 19 | 1187 | 86 |
| 38 | 317 | 4855 | 15 | 0.047 | 22 | 1057 | 85 |
| 39 | 496 | 4509 | 10 | 0.020 | 19 | 791 | 121 |
| 40 | 528 | 3940 | 16 | 0.030 | 22 | 799 | 125 |

TABLE 4

| No | $n_0$ (number/mm$^2$) | $n_0$/S (%) | $n_1$ (number/mm$^2$) | $n_1/n_0$ | $n_2$ (number/mm$^2$) | Chip Disposability Index f | Tool Life (Number of Drillings) |
|---|---|---|---|---|---|---|---|
| Comparative Example | | | | | | | |
| 41 | 116 | 2189* | 18 | 0.155* | 13 | 604* | 104 |
| 42 | 121 | 2086* | 20 | 0.165* | 24 | 586* | 109 |
| 43 | 135 | 2455* | 14 | 0.104* | 25 | 673* | 98 |
| 44 | 142 | 1449* | 17 | 0.119* | 32 | 480* | 139 |
| 45 | 145 | 1465* | 16 | 0.110* | 20 | 626* | 135 |
| 46 | 225 | 2368* | 23 | 0.102* | 18 | 674* | 119 |
| 47 | 218 | 2319* | 22 | 0.101* | 16 | 638* | 105 |
| 48 | 245 | 2402* | 25 | 0.102* | 12 | 686* | 128 |
| 49 | 145 | 1330* | 15 | 0.103* | 15 | 413* | 126 |
| 50 | 278 | 1616* | 29 | 0.104* | 15 | 517* | 157 |
| 51 | 304 | 1737* | 31 | 0.102* | 19 | 497* | 154 |
| 52 | 187 | 1968* | 20 | 0.107* | 10 | 695* | 127 |
| 53 | 169 | 1742* | 18 | 0.107* | 16 | 670* | 121 |
| 54 | 184 | 1840* | 22 | 0.120* | 11 | 610* | 108 |
| 55 | 194 | 1883* | 20 | 0.103* | 11 | 680* | 117 |
| 56 | 179 | 1705* | 18 | 0.101* | 14 | 476* | 124 |
| 57 | 244 | 2465* | 32 | 0.131* | 36 | 595* | 126 |
| 58 | 198 | 1768* | 20 | 0.101* | 18 | 571* | 119 |
| 59 | 326 | 1811* | 33 | 0.101* | 24 | 411* | 158 |
| 60 | 244 | 2465* | 68 | 0.277* | 36 | 596* | 126 |
| 61 | 312 | 1814* | 33 | 0.106* | 34 | 558* | 165 |
| 62 | 210 | 1944* | 25 | 0.119* | 10 | 454* | 118 |
| 63 | 73 | 36500 | 4 | 0.055 | 11 | 22500 | 8* |
| 64 | 477 | 4719 | 23 | 0.048 | 19 | 977 | 34* |
| 65 | 490 | 4945 | 32 | 0.065 | 16 | 906 | 7* |
| 66 | 346 | 6407 | 12 | 0.035 | 4* | 1463 | 20* |
| 67 | 452 | 4264 | 0 | 0.000 | 0* | 1104 | 62* |
| 68 | 555 | 3083 | 0 | 0.000 | 0* | 711 | 82* |
| 69 | 421 | 4048 | 15 | 0.036 | 0* | 904 | 63* |
| 70 | 457 | 4811 | 12 | 0.026 | 0* | 1032 | 50* |
| 71 | 448 | 4619 | 18 | 0.040 | 2* | 1021 | 55* |
| 72 | 498 | 5082 | 17 | 0.034 | 1* | 1092 | 45* |
| 73 | 478 | 4121 | 29 | 0.061 | 6* | 629 | 78* |
| 74 | 145 | 2417 | 12 | 0.083 | 14 | 1150 | 101 |
| 75 | 123 | 2236* | 8 | 0.065 | 3* | 1044 | 105 |

The machinability evaluation was carried out in the following manner. Cylindrical test specimens with a length of 60 mm were taken from the round bar with a diameter of 70 mm as prepared in the manner mentioned above, and the cross section of each specimen was subjected to a drilling test in the perpendicular direction. As for the drilling conditions, a straight shank drill made of a high-speed steel and having a diameter of 6 mm was used, together with a water-soluble cutting fluid (emulsion type), and the feed rate was 0.15 mm/rev, the number of revolutions was 980 rpm, and the hole depth was 50 mm.

In this test, the tool life was evaluated in terms of the number of drillings after which drilling was no more possible due to the wear of the tip. The chip disposability was evaluated in terms of the chip disposability index (f) as calculated by dividing the number of chips cut out per unit mass as counted in the above test by the S content (% by mass) of the relevant steel. It is known that the number of chips per unit mass increases as the S content in steel increases. When the S content is the same, the chip disposability is better when the number of chips per unit mass is greater. The results of these machinability evaluations are also shown in Table 3 and Table 4.

As is seen from the numbers of inclusions and the machinability evaluation results shown in Table 3 and Table 4, the steels having a chemical composition within the range defined herein and satisfying the conditions specified herein with respect to the forms of sulfide and oxide inclusions, namely the steels shown in Table 1, all gave better results with respect to the chip disposability and tool life as compared with the steels shown in Table 2, except the steels Nos. 74 and 75. It is evident that the steels shown in Table 1 are comparable or superior in machinability to the Pb-containing steels Nos. 74 and 75 given as reference examples.

FIG. 1 is a graphic representation of the relationship between chip disposability index and S content as drawn based on the data shown in Table 3 and Table 4. The data for those steels No. 63 to No. 73, which were particularly poor in tool life, have been omitted. From this figure it is evident that the steels of the invention are superior in chip disposability when the S content is at the same level.

Figure 2:
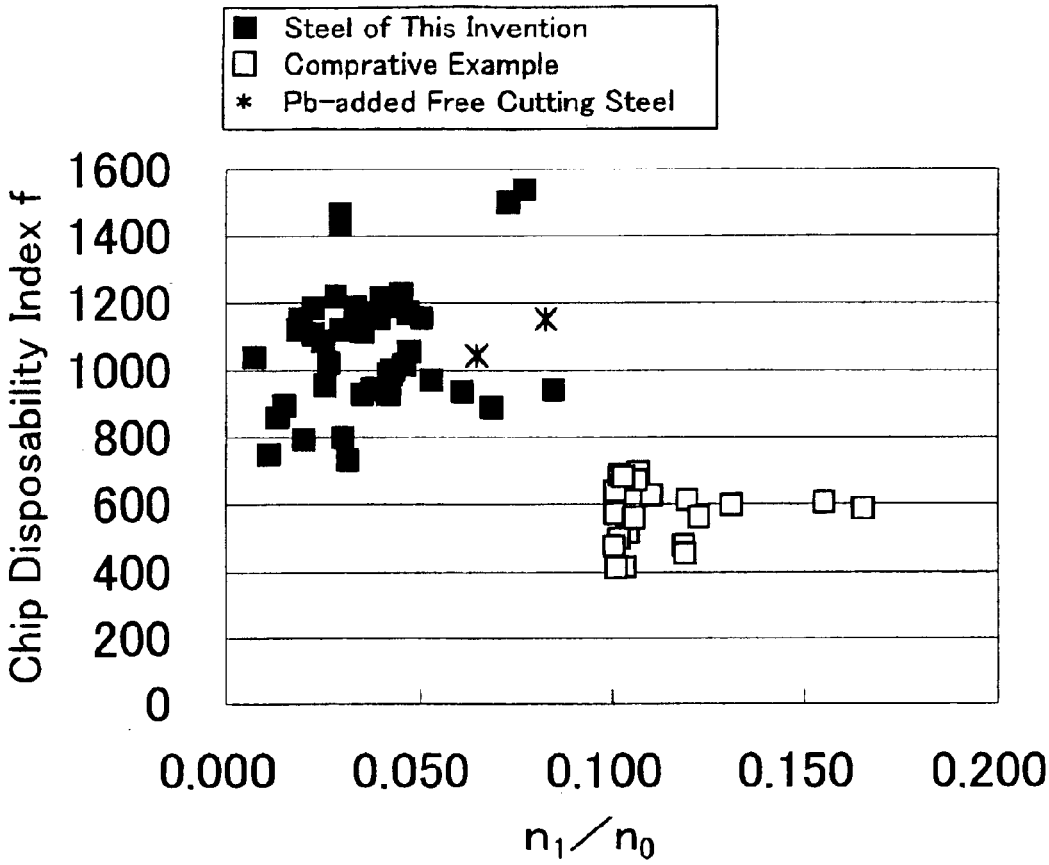
FIG. 2 is a graphic representation of the relationship between chip disposability index and "$n_1/n_0$" of steel.

FIG. 2 is a graphic representation of the relationship between chip disposability index and "$n_1/n_0$" as drawn based on the data shown in Table 3 and Table 4. The data for those steels Nos. 63–73, which were particularly poor in tool life, have been omitted. From this figure, it is seen that the steels of the invention which satisfy the condition "$n_1/n_0 \leqq 0.1$" are superior in chip disposability.

Figure 3:
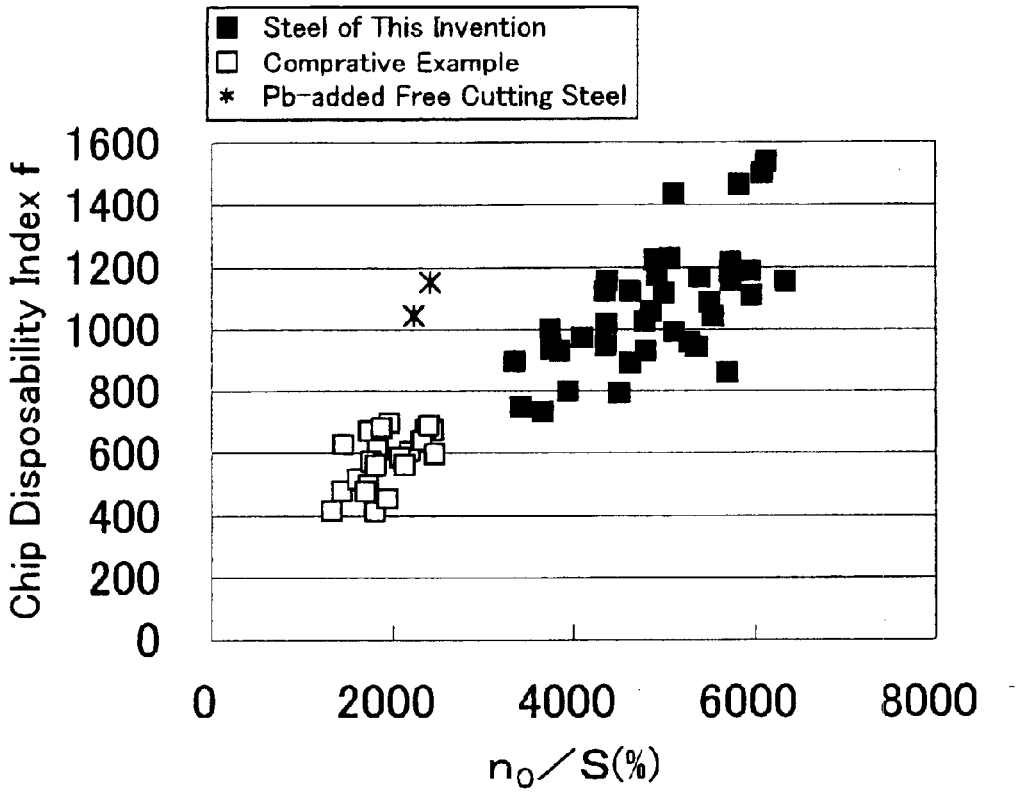
FIG. 3 is a graphic representation of the relationship between chip disposability index and "$n_0$/S (%)" of steel.

FIG. 3 is a graphic representation of the relationship between chip disposability index and "$n_0/S$ (%)" as drawn based on the data shown in Table 3 and Table 4. The data for those steels Nos. 63–73, which were particularly poor in tool life: have been omitted. From FIG. 3, it is seen that the steels of the invention which satisfy the condition "$n_0/S$ (%)$\geqq$2500" are superior in chip disposability.

Figure 4:
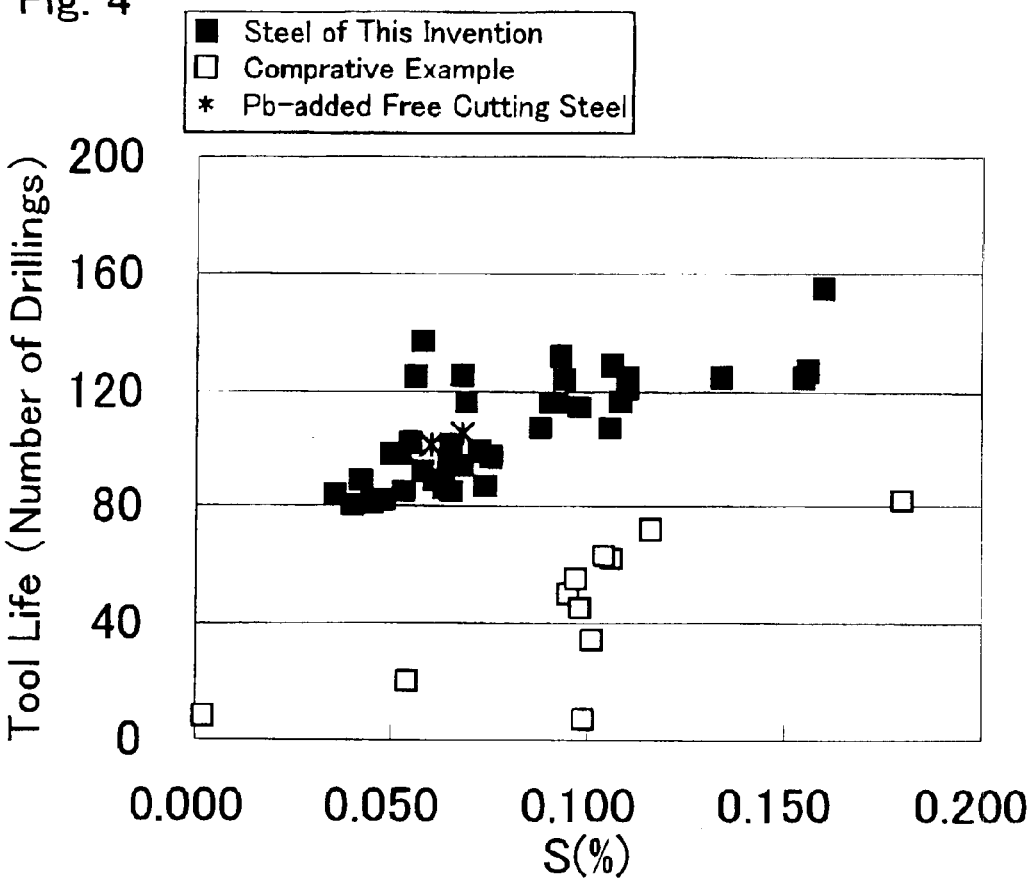
FIG. 4 is a graphic representation of the relationship between tool life and S content of steel.

FIG. 4 is a graphic representation of the relationship between tool life and S content as drawn based on the data shown in Table 3 and Table 4. The data for those steels Nos. 41–62, which were particularly poor in chip disposability, have been omitted. From this figure, it is seen that the steels of the invention are superior in tool life when comparison is made on the same S content level.

Figure 5:
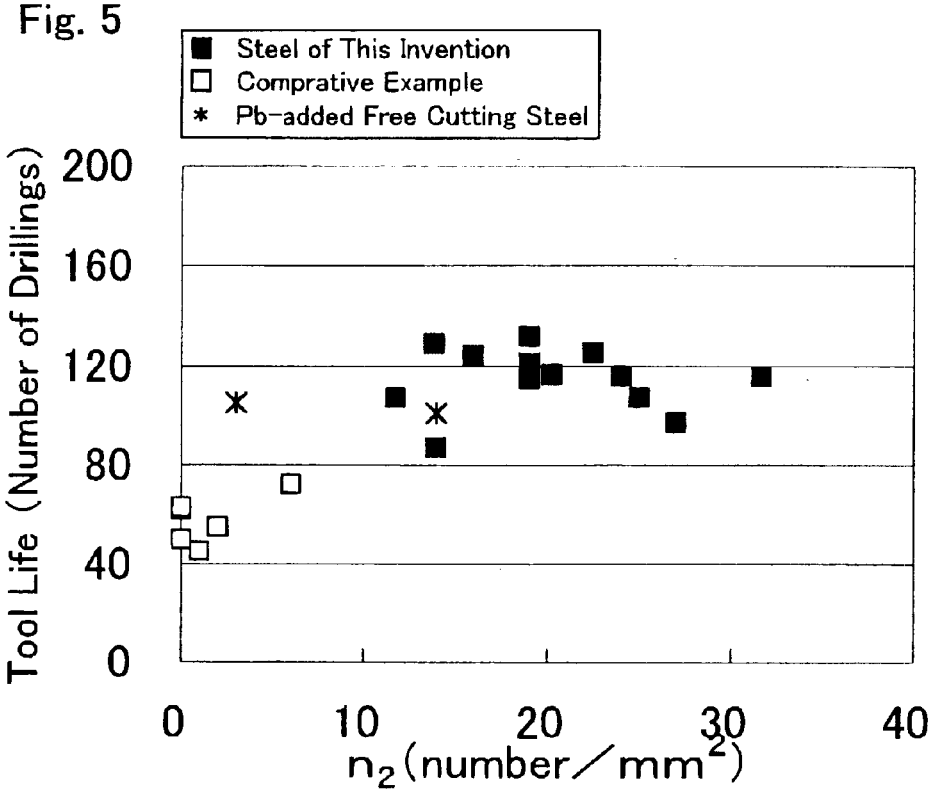
FIG. 5 is a graphic representation of the relationship between tool life and $n_2$ of steel.

FIG. 5 is a graphic representation of the relationship between tool life and $n_2$ as drawn based on the data shown in Table 3 and Table 4. In this figure, the data for those steels Nos. 41–62, which were particularly poor in chip disposability, have been omitted. The data of the steels of the invention (steels Nos. 8–11, 17–18, 21, 23, 27–28, 31–32 and 39) having an S content within the range of 0.074–0.119%, and the date of the comparative steels Nos. 67 and 69–73 have been added for comparison at the same S content level. From FIG. 5, it is evident that the steels of the invention satisfying "$n_2 \geqq 10$" are superior in tool life when comparison is made on the same S content level.

The steel for machine structural use according to the invention is excellent in machinability, in particular chip disposability, and in tool life prolonging effect as well, in spite of containing no Pb. When this steel is used as a parts material requiring machining, the production cost of the parts can be markedly reduced.

We claim:

1. A steel for machine structural use, consisting of, in percent by mass, C: 0.1–0.6%, Si: 0.01–2.0%, Mn: 0.2–2.0%, P: not more than 0.1%, S: 0.005–0.2%, Al: not more than 0.009%, Ti: not less than 0.001% but less than 0.04%, Ca: 0.0001–0.01%, O (oxygen): 0.001–0.01%, N: not more than 0.02% and the balance being Fe and impurities, wherein the following relations (1) to (3) are satisfied with respect to the inclusions in the steel:

$$n_0/S\ (\%) \geqq 2500 \quad (1),$$

$$n_1/n_0 \leqq 0.1 \quad (2),$$

$$n_2 \geqq 10 \quad (3),$$

wherein $n_0$, $n_1$ and $n_2$ are defined as follows:

$n_0$: total number of sulfide inclusions, having a circle equivalent diameter of not less than 1 $\mu$m, per mm$^2$ of a cross section parallel to the direction of rolling, number/mm$^2$;

$n_1$: number of MnS, having a circle equivalent diameter of not less than 1 $\mu$m and containing not less than 1.0% of Ca, per mm$^2$ of a cross section parallel to the direction of rolling, number/mm$^2$;

$n_2$: number, per mm$^2$ of a cross section parallel to the direction of rolling, of oxide inclusions having a composition comprising $CaO—Al_2O_3—SiO_2—TiO_2$ and impurities, with CaO: 5–60%, $Al_2O_3$: 5–60%, $SiO_2$: 10–80% and $TiO_2$: 0.1–40% when the sum of CaO, $Al_2O_3$, $SiO_2$ and $TiO_2$ is taken as 100% by mass, and having a circle equivalent diameter of not less than 1 $\mu$m, number/mm$^2$.

2. A steel for machine structural use consisting of, in percent by mass, C: 0.1–0.6%, Si: 0.01–2.0%, Mn: 0.2–2.0%, P: not more than 0.1%, S: 0.005–0.2%, Al: not more than 0.009%, Ti: not less than 0.001% but less than 0.04%, Ca: 0.0001–0.01%, O (oxygen): 0.001–0.01%, N: not more than 0.02%, and at least one element selected from the first group consisting of Cr: 0.02–2.5%, V: 0.05–0.5%, Mo: 0.05–1.0%, Nb: 0.005–0.1%, Cu: 0.02–1.0% and Ni: 0.05–2.0%, and the balance being Fe and impurities, wherein the following relations (1) to (3) are satisfied with respect to the inclusions in the steel:

$$n_0/S\ (\%) \geqq 2500 \quad (1),$$

$$n_1/n_0 \geqq 0.1 \quad (2),$$

$$n_2 \geqq 10 \quad (3),$$

wherein $n_0$, $n_1$ and $n_2$ are defined as follows:

$n_0$: total number of sulfide inclusions, having a circle equivalent diameter of not less than 1 $\mu$m, per mm$^2$ of a cross section parallel to the direction of rolling, number/mm$^2$;

$n_1$: number of MnS, having a circle equivalent diameter of not less than 1 $\mu$m and containing not less than 1.0% of Ca, per mm$^2$ of a cross section parallel to the direction of rolling, number/mm$^2$;

$n_2$: number, per mm$^2$ of a cross section parallel to the direction of rolling, of oxide inclusions having a composition comprising $CaO—Al_2O_3—SiO_2—TiO_2$ and impurities, with CaO: 5–60%, $Al_2O_3$: 5–60%, $SiO_2$: 10–80% and $TiO_2$: 0.1–40% when the sum of CaO, $Al_2O_3$, $SiO_2$ and $TiO_2$ is taken as 100% by mass, and having a circle equivalent diameter of not less than 1 $\mu$m, number/mm$^2$.

3. A steel for machine structural use consisting of, in percent by mass, C: 0.1–0.6%, Si: 0.01–2.0%, Mn: 0.2–2.0%, P: not more than 0.1%, S: 0.005–0.2%, Al: not more than 0.009%, Ti: not less than 0.001% but less than 0.04%, Ca: 0.0001–0.01%, O (oxygen): 0.001–0.01%, N: not more than 0.02%, and at least one element selected from the second group consisting of Se: 0.0005–0.01%, Te: 0005–0.01%, Bi: 0.05–0.3% and rare earth elements: 0.0001–0.0020%, and the balance being Fe and impurities, wherein the following relations (1) to (3) are satisfied with respect to the inclusions in the steel:

$$n_0/S\ (\%) \geqq 2500 \quad (1),$$

$$n_1/n_0 \leqq 0.1 \quad (2),$$

$$n_2 \geqq 10 \quad (3),$$

wherein $n_0$, $n_1$ and $n_2$ are defined as follows:

$n_0$: total number of sulfide inclusions, having a circle equivalent diameter of not less than 1 μm, per $mm^2$ of a cross section parallel to the direction of rolling, number/$mm^2$;

$n_1$: number of MnS, having a circle equivalent diameter of not less than 1 μm and containing not less than 1.0% of Ca, per $mm^2$ of a cross section parallel to the direction of rolling, number/$mm^2$;

$n_2$: number, per $mm^2$ of a cross section parallel to the direction of rolling, of oxide inclusions having a composition comprising $CaO—Al_2O_3—SiO_2—TiO_2$ and impurities, with CaO: 5–60%, $Al_2O_3$: 5–60%, $SiO_2$: 10–80% and $TiO_2$: 0.1–40% when the sum of CaO, $Al_2O_3$, $SiO_2$ and $TiO_2$ is taken as 100% by mass, and having a circle equivalent diameter of not less than 1 μm, number/$mm^2$.

4. A steel for machine structural use consisting of, in percent by mass, C: 0.1–0.6%, Si: 0.01–2.0%, Mn: 0.2–2.0%, P: not more than 0.1%, S: 0.005–0.2%, Al: not more than 0.009%, Ti: not less than 0.001% but less than 0.04%, Ca: 0.0001–0.01%, O (oxygen): 0.001–0.01%, N: not more than 0.02%, at least one element selected from the first group consisting of Cr: 0.02–2.5%, V: 0.05–0.5%, Mo 0.05–1.0%, Nb: 0.005–0.1%, Cu: 0.02–1.0% and Ni: 0.05–2.0%, and at least one element selected from the second group consisting of Se: 0.0005–0.01%, Te: 0.0005–0.01%, Bi 0.05–0.3% and rare earth elements: 0.0001–0.0020%, and the balance Fe and impurities, wherein the following relations (1) to (3) are satisfied with respect to the inclusions in the steel:

$$n_0/S\ (\%) \geqq 2500 \quad (1),$$

$$n_1/n_0 \leqq 0.1 \quad (2),$$

$$n_2 \geqq 10 \quad (3),$$

wherein $n_0$, $n_1$ and $n_2$, are defined as follows:

$n_0$: total number of sulfide inclusions, having a circle equivalent diameter of not less than 1 μm, per $mm^2$ of a cross section parallel to the direction of rolling number/$mm^2$;

$n_1$: number of MnS, having a circle equivalent diameter of not less than 1 μm and containing not less than 1.0% of Ca, per $mm^2$ of a cross section parallel to the direction of rolling, number/$mm^2$;

$n_2$: number, per $mm^2$ of a cross section parallel to the direction of rolling, of oxide inclusions having a composition comprising $CaO—Al_2O_3—SiO_2—TiO_2$ and impurities, with CaO: 5–60%, $Al_2O_3$: 5–60%, $SiO_2$: 10–80% and $TiO_2$: 0.1–40% when the sum of CaO, $Al_2O_3$, $SiO_2$ and $TiO_2$ is taken as 100% by mass, and having a circle equivalent diameter of not less than 1 μm, number/$mm^2$.

* * * * *

UNITED STATES PATENT AND TRADEMARK OFFICE

CERTIFICATE OF CORRECTION

PATENT NO. : 6,797,231 B2
DATED : September 28, 2004
INVENTOR(S) : Matsui et al.

It is certified that error appears in the above-identified patent and that said Letters Patent is hereby corrected as shown below:

Title page,
Item [57], ABSTRACT,
Line 3, "C: 0.1-.06%." should read -- C: 0.1-0.6%, --
Line 6, "0.0010" should read -- 0.001 --

Column 20,
Line 32, second formula, "$n_1/n_O \geq 0.1$" should read -- $n_1/n_o \leq 0.1$ --
Lines 58 and 59, "Te: 0005-0.01%," should read -- Te: 0.0005-0.01% --

Signed and Sealed this

First Day of February, 2005

JON W. DUDAS
*Director of the United States Patent and Trademark Office*